US006080369A

United States Patent [19]

Cameron

[11] Patent Number: 6,080,369

[45] **Date of Patent: *Jun. 27, 2000**

[54] GAS-TO-GAS HEAT EXCHANGERS FOR USE IN SULPHURIC ACID PLANTS

[76] Inventor: Gordon M. Cameron, 4 Wellesbourne Crescent, Willowdale, Ontario, Canada, M2H 1Y7

[ * ] Notice: This patent is subject to a terminal disclaimer.

[21] Appl. No.: 09/138,657

[22] Filed: Aug. 24, 1998

Related U.S. Application Data

[63] Continuation of application No. 08/512,395, Aug. 8, 1995, which is a continuation-in-part of application No. 08/291,818, Aug. 17, 1994, Pat. No. 5,477,846.

[51] Int. Cl.[7] ..... C01B 17/48; F28D 7/00; F28D 7/16

[52] U.S. Cl. ..... 422/161; 422/160; 422/201; 422/197; 423/528; 423/533

[58] Field of Search ..... 422/160, 161, 422/197, 200, 201; 423/528, 533; 165/160, 161, DIG. 401, DIG. 404, DIG. 409, DIG. 412, DIG. 416

[56] References Cited

U.S. PATENT DOCUMENTS

| | | | |
|---|---|---|---|
| 0,447,396 | 3/1891 | Worthington | 165/101 |
| 1,814,011 | 7/1931 | Snow | 165/159 |
| 1,900,857 | 3/1933 | Berry et al. | 422/161 |
| 2,457,594 | 12/1948 | Nettel et al. | 126/109 |
| 2,817,498 | 12/1957 | Miller . | |
| 2,869,830 | 1/1959 | Cox | 165/139 |
| 2,917,285 | 12/1959 | Schack | 165/139 |
| 3,285,713 | 11/1966 | Poehler et al. | 422/197 |
| 3,859,735 | 1/1975 | Katterjohn, Jr. | 34/86 |
| 5,108,731 | 4/1992 | Schoubye | 423/522 |
| 5,477,846 | 12/1995 | Cameron | 126/109 |

*Primary Examiner*—Marian C. Knode
*Assistant Examiner*—Susan Ohorodnik
*Attorney, Agent, or Firm*—Pillsbury Madison & Sutro LLP

[57] ABSTRACT

A heat exchanger for use in a sulphuric acid manufacturing plant to effect heat transfer between desired gas streams selected from air, sulphur dioxide and sulphur trioxide. The exchanger provides for hot or cold split flow gas streams through the exchanger shell with either mixing or splitting into two or more streams to provide for reduced condensible material condensation, corrosion, metal thermal differential stress and capital equipment cost. A preferred exchanger is used in combination with a sulphur burning furnace to provide an improved preheater.

10 Claims, 11 Drawing Sheets

GAS-TO-GAS HEAT EXCHANGERS FOR USE IN SULPHURIC ACID PLANTS

RELATED APPLICATION

This is a continuation of U.S. application Ser. No. 08/512,395, filed Aug. 8, 1995, which is a continuation-in-part of application Ser. No. 08/291,818, filed Aug. 17, 1994, now U.S. Pat. No. 5,477,846.

FIELD OF THE INVENTION

This invention relates to gas-to-gas heat exchangers for use in sulphuric acid manufacturing plants involving heat exchange between air, sulphur dioxide and sulphur trioxide and also said heat exchangers for use with combustion gases in a preheater system.

BACKGROUND OF THE INVENTION

Plants for the manufacture of sulphuric acid involving either the burning of elemental sulphur or oxidation of metal sulphides to produce sulphur dioxide for subsequent oxidation to sulphur trioxide followed by absorption into sulphuric acid are very large generators of process heat. This process heat comes from the exothermic burning or absorption processes and is generally used for many purposes, such as the heating of gases or raising steam.

The $SO_2$ oxidation is carried out in a series of uncooled catalyst beds of a catalytic converter with heat being removed between beds and before the $SO_3$-containing gases are passed to absorber(s) for $SO_3$ removal. In sulphur burning sulphuric acid plants the bulk of the heat removed from the $SO_3$-containing gas is transferred into steam systems with only limited pre-heating of process or other gases. In plants using an $SO_2$ gas source, the heat is almost completely used to pre-heat incoming cold, dry $SO_2$ feed gas, or, in addition, in the case of the so-called "double absorption process", the cold $SO_2$-containing gas returning from the gases in the first or intermediate absorber. Where surplus heat must be rejected from such plants, often the heat is rejected to either atmospheric air or to plant tail gas in special exchangers designed for this purpose.

Inter-bed exchangers used in such processes are, typically, known as Hot, Intermediate, or Hot IP Exchangers. The Hot Exchanger is normally associated with cooling of the hot gas leaving the first catalyst bed and the other exchangers with cooling of the gases between beds 2 and 3. In all of these exchangers the heat is transferred to colder $SO_2$-containing gases which then pass either directly or through other exchangers to catalyst beds. The gases leaving catalyst beds en route to absorption steps are normally cooled by heat transfer with cold $SO_2$-containing gases from either an acid plant main blower or an Intermediate absorber. It may also be cooled by heat transfer with air in what is known as "$SO_3$ Coolers" or "Air Heaters" or by plant tail gas, in which case the apparatus becomes known as a Tail Gas Healer.

Classic heat transfer between $SO_2$- and $SO_3$-containing gases uses counter-current shell-and-tube heat exchangers in which one gas flows through the tubes of the exchanger and the other gas flows through the shell space as directed by baffles within the shell space. These exchangers are, typically, quite large and for colder duties are made of carbon steel. More recent plants use stainless steel as a construction material for hotter duties such as involving the cooling of the hot $SO_3$ gas leaving beds 1 or 2 where the $SO_3$ gas is hottest. In most large plants, the exchangers are fabricated on site as they are too large and heavy to allow of reasonable transportation. Tubes of exchangers are arranged in a number of different ways with baffles to match the tubing layout. In some cases the tubes are distributed throughout the shell space and ether single or double-segmental baffles have been used. In other designs, the tubes are arranged in the form of annular bundles wherein gas flows radially through the bundle from an open core to a tube-free outer annulus and returns as required. The number of passes across the bundle and the tubing layout will depend on the size of gas flows, thermal efficiency needed and the pressure differences available to cause flow through the shell space.

In plants where heat is rejected from the process to atmosphere, early plants used simple bare gas ducting to cool gases between beds, such as, for example, between a third and fourth catalyst bed in a small single absorption plant. Such apparatus was simple but not effective in rejecting large quantities of process heat. Induced draft heat exchangers were subsequently used to reject significantly larger quantities of heat. The pressure difference available using stack draft was, however, small and, accordingly, fans or blowers were introduced to provide adequate pressure differences and allow the size of such equipment to have reasonable physical dimensions. Where an exchanger handled air that was used elsewhere in process, $SO_2$-containing gas, or plant tail gas, the main acid plant blower provided the driving force for gas flow and separate blowers were unnecessary. Where air was heated and rejected directly to atmosphere a separate air blower was used.

Each of the exchangers described hereinbefore was based on counter-current heat transfer with the two gases entering at opposite ends of the exchanger. Problems exist if the metal of the exchanger becomes too cold or too hot. Gas streams found in sulphuric acid plants normally contain condensible compounds, such as small quantities of sulphuric acid vapour, either from entrained acid from drying operations, from reaction of $SO_3$ formed in the reaction with moisture from inadequate drying, or from hydrocarbons present in the elemental sulphur if sulphur is used. As a result, there is the possibility of sulphuric acid condensation from such gases when the temperature of the metal exchanger falls below the condensation temperature. This condensation produces significant corrosion. Although the condensation temperature is normally not a factor in the hotter exchangers, it is a problem in colder exchangers such as Cold or Cold IP Exchangers, $SO_3$ Coolers or Tail Gas Heaters.

Where the condensation risk is serious, special measures are often taken to keep metal temperatures above the minimum at which condensation takes place. One such technique is to recycle hot air from the exit of a $SO_3$ cooler back to its inlet. This corrective action is widely used, but requires a much larger fan and heat exchanger and, hence, larger capital and operating costs. Where tail gas is being heated, there is little prospect of a recycle stream without the need for a separate fan and the operator is, thus, normally forced to accept any condensation that results. Such equipment is therefore very dependent on the quality of the drying and mist elimination equipment upstream.

Conventional exchanger designs result in large exchangers having high flow resistance due to the large gas flows involved. The large exchangers also often have significantly different thermal expansions between adjacent parts of the exchangers. Cracked tube sheets, broken tube-to-tube sheet joints and leaks can result from excessive differential thermal stresses in such units.

The shell and tube exchanger having a shell full of tubes has fallen into disfavour in the last two decades as the shell and adjacent tubes have significantly different thermal expansions and generate excessive stresses on tube-to-tube sheet joints or on tube sheet-to-shell joints. Heat transfer varied significantly from tube-to-tube in the shell space and the unit used many more tubes than necessary. Baffle arrangements included single and double segmental baffles with the problem being common to both baffle arrangements.

In an alternative design, the tubes of the exchanger are confined between chords with open dome spaces on each side of the tube bundle for gas flow between cross-flow passes. With single segmental baffles, this arrangement provides for gas transfer from one shell pass to the next in the dome space where no tubes are located. Better heat transfer is provided as all of the tubes are located in a zone where good gas flow is assured but pressure drop in the shell space is high. This design has also been used with double segmental baffles. In the double segmental baffle variation, gas flows either around and parallel to tubes in the central portion of the bundle or in the two dome spaces which are free of tubes. The gas flows from the edge of the bundle to the centre of the bundle and then back. While there are variations in tube temperature as not all tubes are subjected to the same shell side gas flow, this exchanger design allows smaller shells to be used which often offers a cost advantage.

A further alternative design uses an annular dome space next to the shell and an axial dome space. Both dome spaces are free of tubes. Gas flows from pass to pass in the dome spaces and radially across the bundle. This design uses several shell passes, offers better temperature distribution across the tube bundle and fewer mechanical problems. It also has significantly less pressure drop and requires less surface than either the single or double segmental baffled units hereinabove described.

In a yet further alternative design, simple crossflow heat transfer has also been used but with mixed success. In this case, the shell side gas enters one side of the shell and flows across the bundle and out of a nozzle on the other side. The tube side gas flows through all the tubes in parallel. This design results in significant differences in tube temperature between the tubes on the inlet shell side gas entry and the tubes on the other side and, accordingly, the exchanger tends to distort towards a "banana" shape. If the temperature difference between the inlet and outlet tube side gas is modest, the differential expansion is modest and the design concept can be quite useful. On the other hand, such an exchanger when located after a first catalyst bed with inlet tube gas temperatures approaching 650° C. can have very strong differential forces and be almost impossible to design mechanically.

Combined combustion furnaces and heat exchangers, commonly known as process preheaters are used in sulphuric acid plants to heat process gases such as air and sulfur dioxide. The preheaters may be used intermittently or continuously. Conventional preheater systems have included horizontally or vertically aligned furnaces which burn fossil fuels such as natural gas or various grades of fuel oils. The heat exchangers have included vertically or horizontally aligned exchangers wherein heat transfer to the process fluid from the furnace gas occurs. Typically, the flow of the furnace gas is countercurrent to the flow of the process gas to enhance transfer of energy and, thus, improve efficiency.

In the manufacture of sulfuric acid, older preheater systems generally comprised a furnace and an associated heat exchanger wherein the furnace was formed of a brick-lined cylindrical shell having an air blower wherein the heated furnace gas exited from the end remote from the air intake and blower. Such fossil fuel combustion furnaces produced a flame extending as much as 3–4 meters in the furnace and only modest efforts were expended to efficiently mix fuel and air. Such furnaces generally required significant periods of time to heat the brick lining to operating temperatures, which brick preheating time affected the operation of the downstream plant.

Such heat exchangers were initially formed of carbon steel, which limited the temperatures that could be generated in the furnace to less than 650° C. Further, these exchangers generally had their heat exchanger tubes vertically aligned and received furnace gas therethrough, while the shell space received the process gas to be heated. These carbon steel exchangers were susceptible to high temperature scaling and, thus, were frequently replaced. In addition, in consequence of the very high temperatures produced in the furnace, it was necessary for large quantities of excess air and/or, larger exchangers to be used. High temperature combustion further increased the risks of formation of unwanted nitrogen oxides and smoke in the preheater exit gas.

Later preheater exchangers were formed of stainless steel and were, thus, able to operate at higher temperatures to provide higher thermal efficiencies. In the sulfuric acid industry, the preheater systems generally had long, horizontal, cylindrical furnaces with either a vertical exchanger or a horizontal exchanger mounted on top of the horizontal furnace. These newer designs also permitted rapid firing in the furnace, incorporated flue gas recycle and air preheating where required to improve thermal efficiency and to minimize formation of nitrogen oxides.

Preheater systems presently in use suffer from a number of disadvantages. It has been found that the shape of the combustion flame of the furnace may be variable in operation and cause inefficient radiative transfer of heat to the heat exchanger. Relatively low intensity combustion results in a longer residence time of the reactants in the furnace which favours the formation of unwanted nitrogen oxides. Further, high temperatures of the metal at the hot end of an exchanger may cause high temperature damage by scale formation and uneven thermal stresses. Yet further, most preheaters of the prior art are not easily adapted to higher energy efficiency by such optional features such as stack gas recycle and air preheating with stack gas.

Thus, heat exchange equipment and processes of the prior art in the sulphuric acid field suffer from one or more of the following problems, viz:

1. The unwanted production of condensed sulphuric acid.
2. The requirement to recycle coolant fluid.
3. The consumption of electric power to move fluids.
4. Relatively large size in capacity in size of equipment is required with associated extra economic cost.
5. Unnecessary thermal stresses due to differential thermal expansion.
6. The need to provide the heat exchange in metal at an operative temperature above the gaseous fluid condensation temperature.

Accordingly, there is a need for improved heat exchanger equipment and associated processes of use in the sulphuric acid plant industry. There is also a specific need for an improved preheater system which does not suffer from the aforesaid disadvantages of prior art preheaters.

SUMMARY OF THE INVENTION

It is an object of the present invention to provide an improved shell-and-tube heat exchanger of reduced physical structural size while allowing for the efficacious use of volumes of gas through the shell space similar to volumes of gas encountered in standard heat exchangers presently in use.

It is a further object of the present invention to provide an improved shell-and-tube heat exchanger which allows of better metal temperature control to reduce the amount of corrosion and fluid condensation or avoid high temperatures leading to the formation of scale.

It is a yet further object of the present invention to provide an improved sulphuric acid manufacturing plant having an improved shell-and-tube heat exchanger as hereinabove provided.

It is a still yet further object of the present invention to prove an improved process of exchanging heat between two gases in a shell-and-tube heat exchanger.

It is a further object of the present invention to provide a preheater which occupies a relatively small space within the overall manufacturing plant.

It is a further object of the present invention to provide a preheater, $SO_3$ Cooler, Air Heater, or Tail Gas Reheater, of reduced conventional diameter and size and resultant economic cost.

It is a further object to provide a preheater system which is operative at relatively high furnace temperatures, reduced furnace gas flow and is of reduced conventional furnace size and exchange area.

A further object is to provide an improved heat exchanger for use in a preheat, $SO_3$ Cooler, Air Heater or Tail Gas Reheater system having smaller than conventional shell diameters in consequence of reduced flow resistance of the gas in the shell and reduced pressure losses.

It is a further object to provide an improved heat exchanger having improved controllability of metal temperatures in the heat exchanger.

A further object is to provide an improved preheater more readily adaptable to receive a secondary air/stack gas exchanger and provide improved efficiency and desired stack dimensions.

These and other objects of the invention will be readily seen from a reading of this specification as a whole.

The above improvements emanate from the provision of two or more split flows of gas into or out of a shell-and-tube heat exchanger and through one or more inlets and outlets of the shell as the case may be, to provide either, (a) a split flow of hot or cold input gas which is combined within the shell space adjacent to a single shell outlet through which resultant colder gas or hotter gas, respectively, exits the shell; or (b) a single flow of hot or cold input gas which is subsequently split within the shell space adjacent a single shell inlet to provide two or more colder or hotter exit gas streams, respectively, which streams exit the shell spaces through respective shell outlets.

This invention is thus concerned in a primary aspect with heat exchangers in which significant quantities of heat are transferred from $SO_3$-containing or combustion gases to colder gases in sulphuric acid plants. Where the present invention in one aspect is used to cool gas between catalyst beds, the resulting exchanger of the invention may be advantageously smaller than conventional heat exchangers and provide lower flow resistance.

In a further aspect, where the present invention is used to cool $SO_3$-containing gases prior to $SO_3$ absorption, heat rejection systems are simpler, smaller, less costly and offer less flow resistance.

The present invention provides exchangers in which extreme temperatures, either hot or cold, can be moderated to improve equipment life.

Surprisingly, I have found that many significant advantages can be found by splitting the shell side gas stream into at least two, preferably equal, streams and providing separate flow paths for each stream in the shell space of the exchanger. The improvement can be obtained in some cases when the hot gas is passing through the shell space and in other cases where the cold gas stream passes through the shell space.

In an embodiment where the hot gas stream passes through the shell space and air or tail gas passes through the tubes, one portion of the shell gas is introduced at one tube sheet and the other portion at the other tube sheet and both streams then flow as directed by internal baffles to a common point intermediate in the exchanger where the streams combine and leave the exchanger. The resulting metal temperature in the cold end of the exchanger is then set by incoming hot gas in the shell and the cold incoming coolant and is significantly hotter than in the conventional case where both streams are cold at the tube sheet. In this way, condensation risks can be avoided. At the same time, the flow at any plane in the exchanger is only half of the total flow and a significantly smaller shell can be provided. The improvement can also eliminate the need for recycle streams and further reduce the tube side flow in the exchanger as in an $SO_3$ Cooler or Air Heater.

In an embodiment where a cold gas stream is used in the shell space, as might be the case in a preheater, the hot tube side gas initially will exchange heat with cold incoming fluid and the hot tube sheet temperature will be less than that which would result from having both hot fluids in contact with the hot tube sheet. The resulting scale formation risk is thus reduced significantly. In addition, hotter gas temperatures can be tolerated while keeping metal temperatures at a reasonable level. As mentioned in the aforesaid embodiment, the shell only has to handle half of the shell side flow at any plane and the shell size will be significantly smaller, offering economic advantages over the prior art solutions.

In an embodiment where the heat exchanger is used for gas cooling between converter beds, the splitting of the shell flow can offer advantages regardless of the gas stream that is in the shell, primarily as offering a smaller exchanger with a lower flow resistance route for gas flow. This advantage is independent of the desire to moderate metal temperatures.

In both cases of split shell side flow, equipment size is significantly reduced, allowing shop-fabricated equipment in plants where previously the equipment had to be erected in the field because of excessive size; and pressure losses can be drastically reduced by comparison with previous practice. Where the hot gas is in the shell space, as in $SO_3$ coolers, the invention allows simple once-through cooling without the complex and cumbersome air recycle arrangements and large exchangers of the prior art practice.

Accordingly, in its broadest aspect the invention provides a shell and tube, gas-to-gas heat exchanger for use in the manufacture of sulphuric acid by the contact process involving heat transfer between dry gases, said exchanger comprising a shell having a first shell portion defining a first shell space, a second shell portion defining a second shell space and a third shell portion defining a third shell space, said second shell space being located between said first and said third shell spaces; a tube bundle comprising a plurality of tubes within said shell and extending longitudinally through said first shell space, said second shell space and said third shell space; said shell having a first gas conduit means and a second gas conduit means; each of said tubes having a tube gas input means and a tube gas output means; and baffle means; the improvement wherein said first shell portion further defines a first shell aperture in communication with said first shell space and through which a first gas stream operably passes; said second shell portion further defines a second shell aperture in communication with said second shell space and through which a second gas stream operably passes; said third shell portion further defines a third shell aperture in communication with said third shell space and through which a third gas stream operably passes; said baffle means so located within said first, said second and said third shell spaces as to operatively direct said first gas, said second gas and said third gas streams within said first shell space, said second shell space and said third shell space, respectively, in flow across said tube bundle; wherein said second shell space constitutes a chamber within which said second gas stream comprises a mixture of said first gas stream and said third gas stream.

This invention is concerned in one aspect with heat exchange processes in which significant quantities of heat are transferred to atmospheric air or tail gas from converted gases en route to absorption processes. Direct rejection of process heat to the atmosphere reduces the size of the absorption and acid cooling systems associated therewith and provides better absorption and better life in the typically used brick-lined absorption towers. In addition, the present invention provides for the efficient and improved heating of tail gas from the plant or hot air by providing gases with higher buoyancy to enhance dispersion in the atmosphere to alleviate local nuisance concentrations of $SO_2$ and $SO_3$.

The present invention is also of use where hot air is needed for combustion purposes in a waste furnace as found in a waste acid plant burning alkylation or other waste acid.

In contrast to the conventional technology hereinbefore described, I have thus found that significant advantages can be obtained by the practice of the present invention in passing the fluid being heated through the tube side of the heat exchanger and by passing the hot fluid through the shell and further by splitting the shell side fluid in such a way that the exchanger is split into co-current and counter-current zones. The two shell side streams enter at the tube sheets and flow toward a point on the shell intermediate between the two tube sheets set by the heat transfer, passing across the tube bundle in the exchanger several times in each zone before reaching the outlet connection. A first hot gas stream then passes immediately above the cold end tube sheet, i.e. the tube sheet so designed as being the end at which the cold fluid enters the tubes, wherein the metal temperature is then set by the hottest shell side fluid and the coldest tube side fluid, instead of by the two coldest fluids. This stream is then cooled in co-current heat exchange with the cold fluid to result in metal temperatures being biased towards the hottest fluid temperature. The second stream by comparison, enters below the tube sheet and exchanges heat to the tube side fluid but wherein the temperatures are sufficiently high so that there is no condensation risk. In addition, the heat transfer in this second zone is counter-current to allow relatively hot tube side fluid to be generated.

Since the size of a heat exchanger heating the large atmospheric pressure gas streams found in sulphuric acid plants is primarily set by the size of the streams and only secondarily by the heat transfer service involved, the present invention incorporating the splitting of the shell side flow essentially in two, reduces the requirement for shell space and the exchanger diameter by approximately 30%. This, thus, provides a heat exchanger of use in the present invention as a much more fabricable and shippable exchanger. In addition, the present invention eliminates the need for recirculation and reduces any fan capacity to that of the cold fluid stream, in contrast to the classic design requiring circulation. Further, where tail gas is being heated and a fan is not normally present or, where air is being heated for us in an up stream furnace, the present invention allows metal temperatures in the exchanger to be kept above conditions generating condensation with reasonable assurance and avoids the need for more expensive materials or recirculation devices.

In a further aspect the invention provides an improved process gas preheater system for raising the temperature of a process gas by heat transfer with a hot furnace gas, said system having a combustion furnace in communication with a shell and tube heat exchanger, wherein said furnace operably produces said hot furnace gas and comprises air inlet means, fossil fuel inlet means, a combustion chamber and hot furnace gas exit means; and said heat exchanger comprises an exchanger shell, a first end tube sheet and a second end tube sheet, which said shell and said tube sheets define a shell space;

a tube bundle comprising a plurality of longitudinal tubes retained by said first and second end tube sheets within said shell space and comprise heat exchange means;

hot furnace gas inlet means;

cooled furnace gas outlet means;

process gas inlet means; and heated process gas outlet means;

said plurality of tubes in communication with said hot furnace gas inlet means to operably provide said tubes with said hot furnace gas and said cooled furnace gas outlet means;

the improvement comprising said process gas inlet means having i. a first process gas inlet aperture adjacent said first tube sheet and in communication with said shell space, and ii. a second process gas inlet aperture adjacent said second tube sheet and in communication with said shell space.

Preferably, the heated process gas outlet means comprises a gas outlet essentially midway between said first and said second tube sheets and in communication with said shell space.

In a further preferred feature, the tubes of the tube bundle of the heat exchanger are aligned substantially vertical above the furnace. More preferably, the furnace is vertically aligned and has means to operably direct input air flow and input fuel flow vertically upward to operatively create a vertical flame substantially central around the vertical axis of the furnace and wherein the tube bundle of the heat exchanger is vertically aligned and disposed above the furnace such that the central axis of the bundle is co-axial with the aforesaid furnace vertical axis.

Thus, in a preferred aspect, the invention provides a preheating system having a combustion furnace mounted under a vertical heat exchanger with the furnace shell and exchange shell having a common vertical axis.

In operation, furnace gas upwardly passes through the tubes of the vertical exchanger. The inlet end of the exchanger is, most preferably, protected, where appropriate by a heat radiation shield, two ferrules and refractory materials from the high temperature of the furnace flame.

From the upper vestibule of the exchanger, cooled furnace gas is either recycled to the furnace or is passed to an exhaust stack.

For improved thermal efficiency it is sometimes advantageous to add recycled stack gas, in whole or in part, instead of excess air to the system. The recycled gas may then be added as a quench downstream of the high intensity zone of the furnace and before entering the exchanger.

In a further modification according to a further aspect of the invention, cooled furnace gas from the heat exchanger is passed to a air/stack gas exchanger mounted co-axially above the main exchanger.

Thus, in the practice of the invention, cool process gas entering the exchanger is split into two streams, one entering the shell space of the vertical exchanger below the top tube sheet and the second stream entering above the bottom tube sheet. The two streams flow away from their respective tube sheets towards, preferably, substantially, the mid-point of the exchanger where the heated process gas exits and flows to a subsequent process.

Thus, in a further aspect, the invention provides an improved process for raising the temperature of a process gas by heat transfer with a hot furnace gas, comprising burning a fuel in a combustion furnace with an oxygen-containing gas to produce a hot gas; feeding said hot gas through the tubes of a heat exchanger; feeding said process gas to the shell space of said heat exchanger for heat transfer with said hot gas to produce a heated gas and a cooled gas; the improvement comprising feeding a first portion of said process gas to said shell space adjacent a first end of said heat exchanger; feeding a second portion of said process gas to said shell space adjacent a second end of said heat exchanger; and collecting said heated gas as a combined heated said first and said second portions.

In a further aspect, the invention provides a process as hereinabove defined wherein said furnace is vertically aligned and has means to direct said oxygen-containing gas input and said fuel input vertically upward to create a vertical flame substantially central around the vertical axis of the furnace and wherein the tube bundle of the heat exchanger is vertically aligned and disposed above said furnace such that the central axis of the bundle is co-axial with said furnace vertical axis; and comprising directing said oxygen-containing gas input and said fuel input to create said vertical flame and a vertical flow of said hot gas and directing said vertical flow of said hot gas to said first end of said heat exchanger.

The preheater system of the present invention has the ability to incorporate air heating without increasing the required plant area. In practise, the apparatus advantageously provides relatively cold process gas adjacent to the lower hottest tube sheet where the hot furnace gas enters the exchanger. The resulting maximum temperature in the exchanger is shifted in consequence of the splitting of entry process gas flow and the maximum metal temperature for any given inlet furnace gas temperature is relatively significantly lower. In consequence of the splitting of the shell side process gas flow into two streams, there is provided a desirable reduction in diameter and size of the exchanger. With a split stream as aforesaid, the shell space handles part of the gas flow at any given elevation; which also results in a reduced exchanger diameter and economic cost.

The present invention provides for improved control of the metal temperatures in the exchanger. Shell side heat transfer coefficients in preheater exchangers are, typically, significantly higher than the associated tube side coefficient. This results in metal temperatures which are closer to the shell gas temperature than that of the hot tube gas. This reduces the rate of high temperature corrosion and/or allows of higher furnace operating temperatures. Further, the invention provides cooling at both tube sheets and the maximum metal temperature is likely to be between the tube sheets and only affecting the tube metal. The invention further offers an effective furnace/heat exchanger design providing a more compact system, optimal furnace conditions and having a high heat flux in the exchanger.

BRIEF DESCRIPTION OF THE DRAWINGS

In order that the invention may be better understood preferred embodiments rill now be described by way of example only with reference to the accompanying drawings wherein:

With reference to FIG. 1, this shows a horizontal furnace 10 having air and fuel streams 12, 14, respectively entering furnace 10 at one end thereof and a hot furnace gas stream 16, exiting from furnace 10 at the other end thereof. Fuel 14 is burned in combustion furnace 10, typically, at a temperature of up to 650 degrees C. Furnace 10 has a brick lining 18 which must only be heated slowly and, thus, limits the availability of the preheater system for plant start-up purposes.

Figure 1:
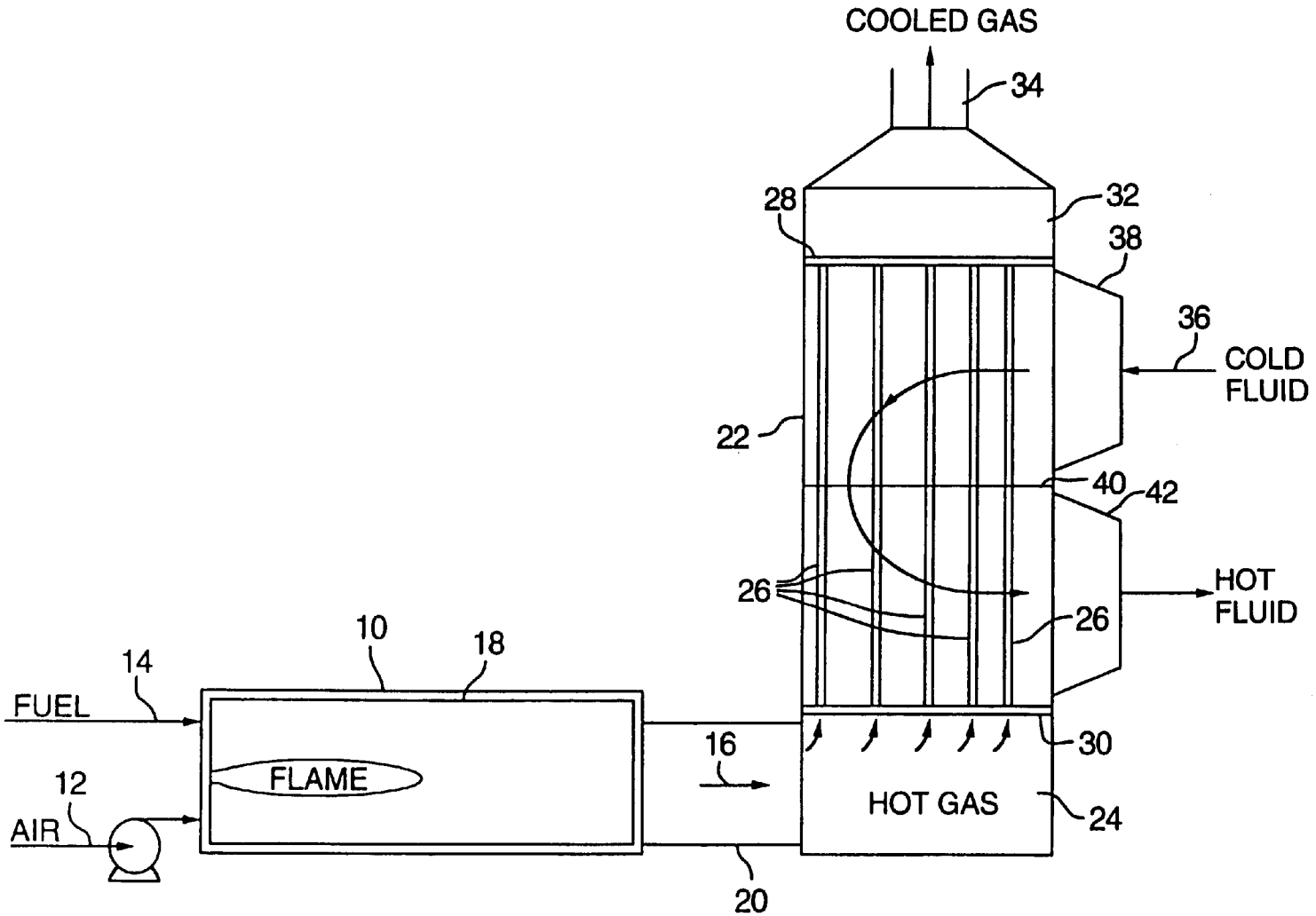
FIG.1.(PRIOR ART)
FIG. 1 represents a diagrammatic vertical cross-sectional view of a prior art preheater.

Hot furnace gas 16 passes through a nozzle 20 into preheat exchanger shown generally as 22 through exchanger lower vestibule 24. Exchanger 22 has a plurality of tubes 26 which are retained within the shell 22 by upper and lower tube sheets 28, 30, respectively. Hot gas 16 enters tubes 26 and exits through upper vestibule 32, as now cooled furnace gas out of exchanger furnace gas exit 34. Cold incoming process fluid-gas or air to be heated enters the exchanger shell space as stream 36 through inlet 38 and flows, typically, around tubes and baffle 40 as denoted by the arrow and out of process gas outlet 42 as hot fluid.

In the above prior art embodiment, the gas flows on the furnace side are large and typically there is a large amount of excess air and unwanted production of smoke and nitrogen oxides. In addition, thermal efficiency is relatively low due to the inability to cool the furnace gases to very low temperatures without creating condensing conditions in exchanger 22.

Figure 2:
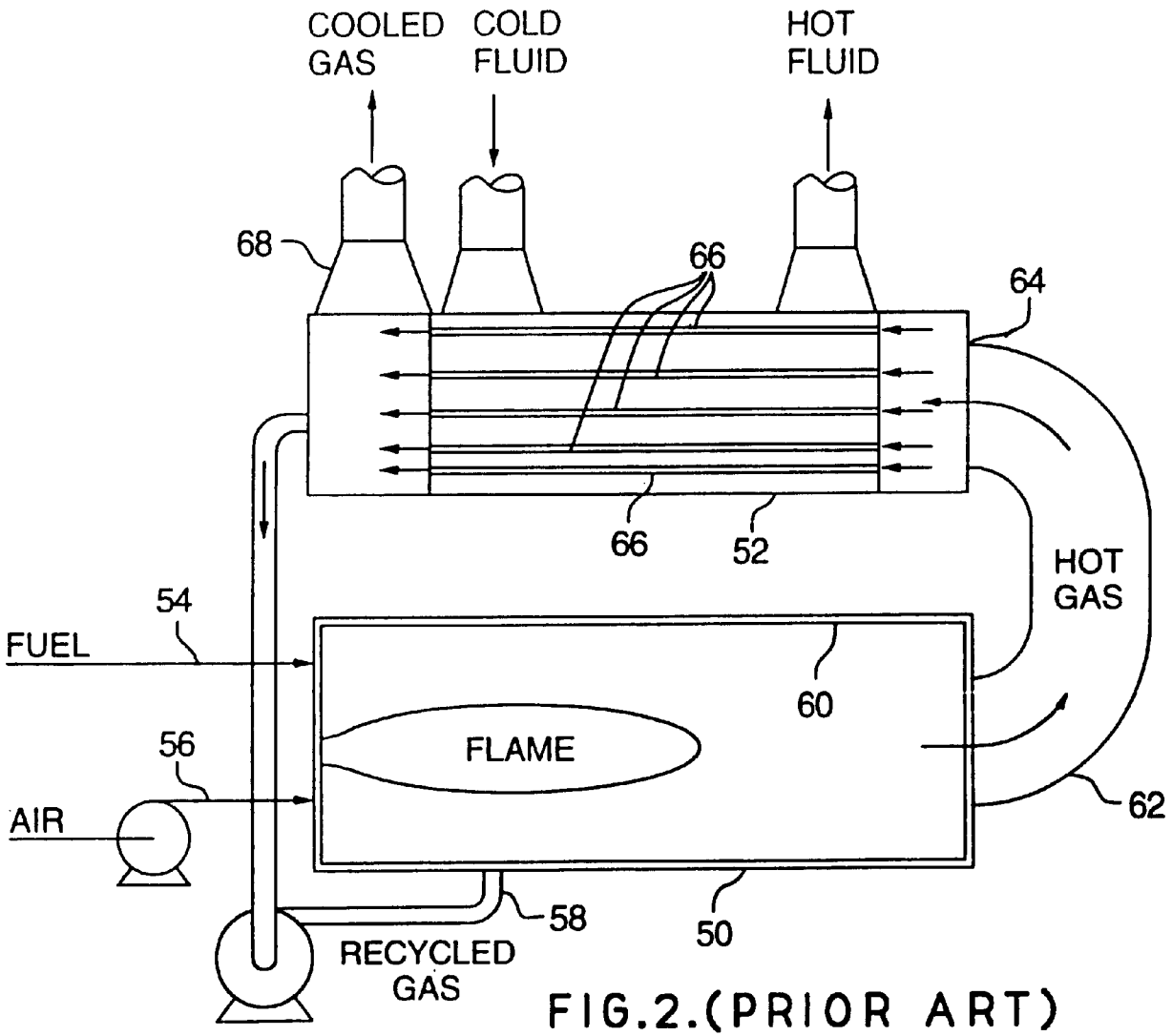
FIG.2.(PRIOR ART)
FIG. 2 represents a diagrammatic vertical cross-sectional view of an alternative preheater system of the prior art.

FIG. 2 shows generally a horizontal combustion furnace 50 in association with a horizontally aligned heat exchanger 52 disposed upon furnace 50. Furnace 50 has fuel inlet 54 and gas inlets 56, 58, for fresh combustion air and a recycled stack gas stream, respectively. Furnace 50 has a brick lining 60 and hot furnace gas outlet nozzle 62 in the form of a 180 degree return bend which discharges horizontally into hot furnace gas inlet 64 of exchanger 52. Hot furnace gas flows horizontally through exchanger tubes 66 and out of outlet 68 as cooled furnace gas. From outlet 68, the cooled gas flows either to a stack or through recycle line 58. The embodiment of the prior art shown in FIG. 2 is more compact than that of the embodiment of FIG. 1 and, typically, has stainless steel tubing.

Figure 3:
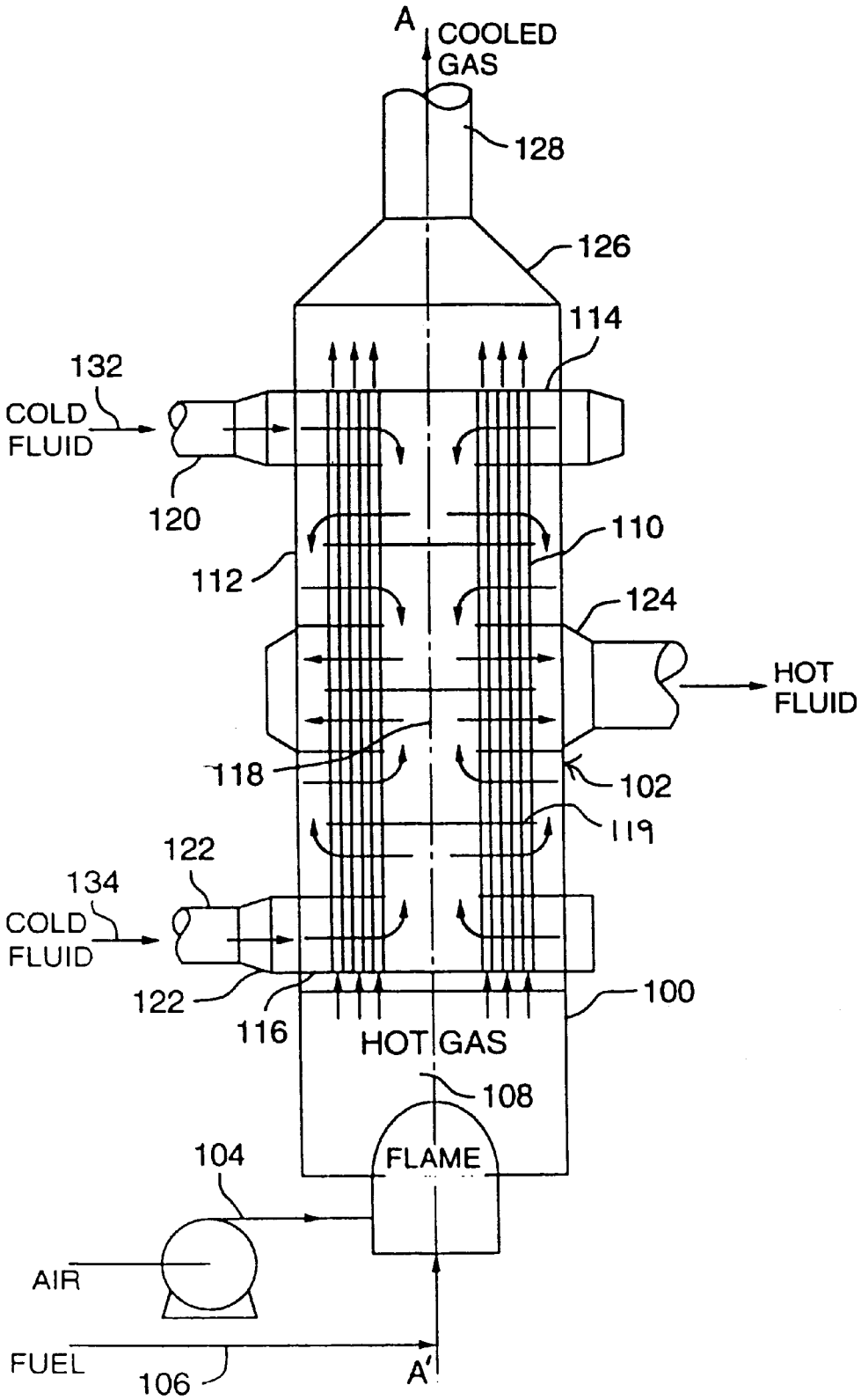
FIG. 3 represents a diagrammatic vertical cross-sectional view of a preheater system according to the invention.

Reference is now made to FIG. 3, which represents a further embodiment preheater of the invention having a vertical furnace 100 supporting a vertical heat exchanger shown generally as 102.

Furnace 100 has an air inlet 104 and a fuel inlet 106. Furnace 100 is formed of carbon steel having an inner lining of insulating brick and exchanger 102 of stainless steel and are so arranged that right vertical cylindrical furnace chamber 108 and the central axis of tube bundle 110 of exchanger 102 are co-axial and have a common central vertical axis A-A'.

Exchanger 102 has a shell 112, an upper tube sheet 114 and lower tube sheet 116 defining a shell space 118 therebetween. Heat exchanger 102 has an upper process fluid inlet 120 adjacent upper tube sheet 114, a lower process fluid inlet 122 adjacent lower tube sheet 116 and a combined heated process fluid outlet 124, midway between upper and lower tube sheets 114, 116, respectively, in communication with shell space 118. Exchanger 102 has a cooled furnace gas upper vestibule 126 leading to outlet 128.

In operation, incoming air and fuel are burned in furnace chamber 108 to provide a furnace gas which flows up into tubes 110 to outlet vestibule 126 and outlet 128. An incoming cold process gas fluid stream splits into two essentially equal side streams 132, 134 which enter shell space 118 through inlets 120 and 122, respectively. The split streams flow down and up, respectively, through exchanger 102 around tube bundle 110 and baffles 119 as shown, generally, by the arrows. The cooled process fluid gas combines at intermediate points in exchanger 102 and exit through outlet 124.

It can be seen that the lower tube sheet 116 of FIG. 3 is exposed to the hottest gas only on the furnace gas side. On the shell side, tube sheet 116 is exposed to the coldest gas. This is to be contrasted to the lowest or first tube sheet of FIG. 1 and FIG. 2 where the inner surface of the tube sheets is exposed to the hot process gas on the shell side. Thus, the FIG. 3 arrangement according to the invention provides for a drastic lowering of the tube sheet temperature or, in the alternative, an ability to use much higher furnace temperatures without exposing tube sheet 116 to excessive temperatures. It is suggested that the maximum tube metal temperature will occur about the mid-point of exchanger 102 where combined hot process fluid is present and the only significant metal exposed to the relatively high temperature will be tubes 110 which bear only a light mechanical load. The combination of the furnace and heat exchanger on a common vertical axis provides a discharge point for cooled furnace gases higher in the air and offers a decrease in the height of a stack needed to optionally discharge the combustion products to atmosphere.

Figure 4:
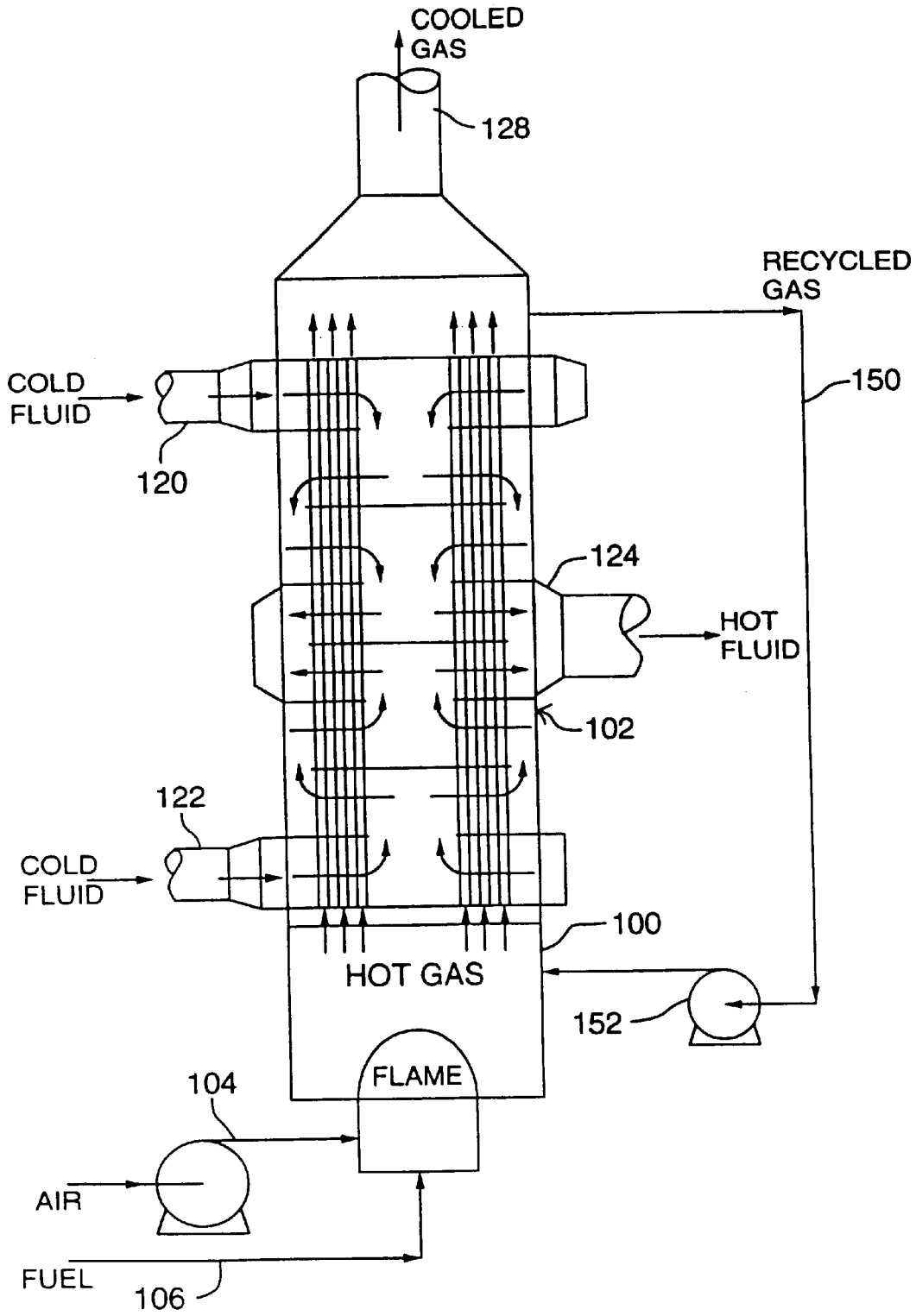
FIG. 4 represents a diagrammatic vertical cross-sectional view of a preheater system incorporating a stack gas recycle, according to the invention.

FIG. 4 shows a variation of the apparatus of the present invention which incorporates a stack gas recycle line 150 associated with a separate fan or blower 152.

Figure 5:
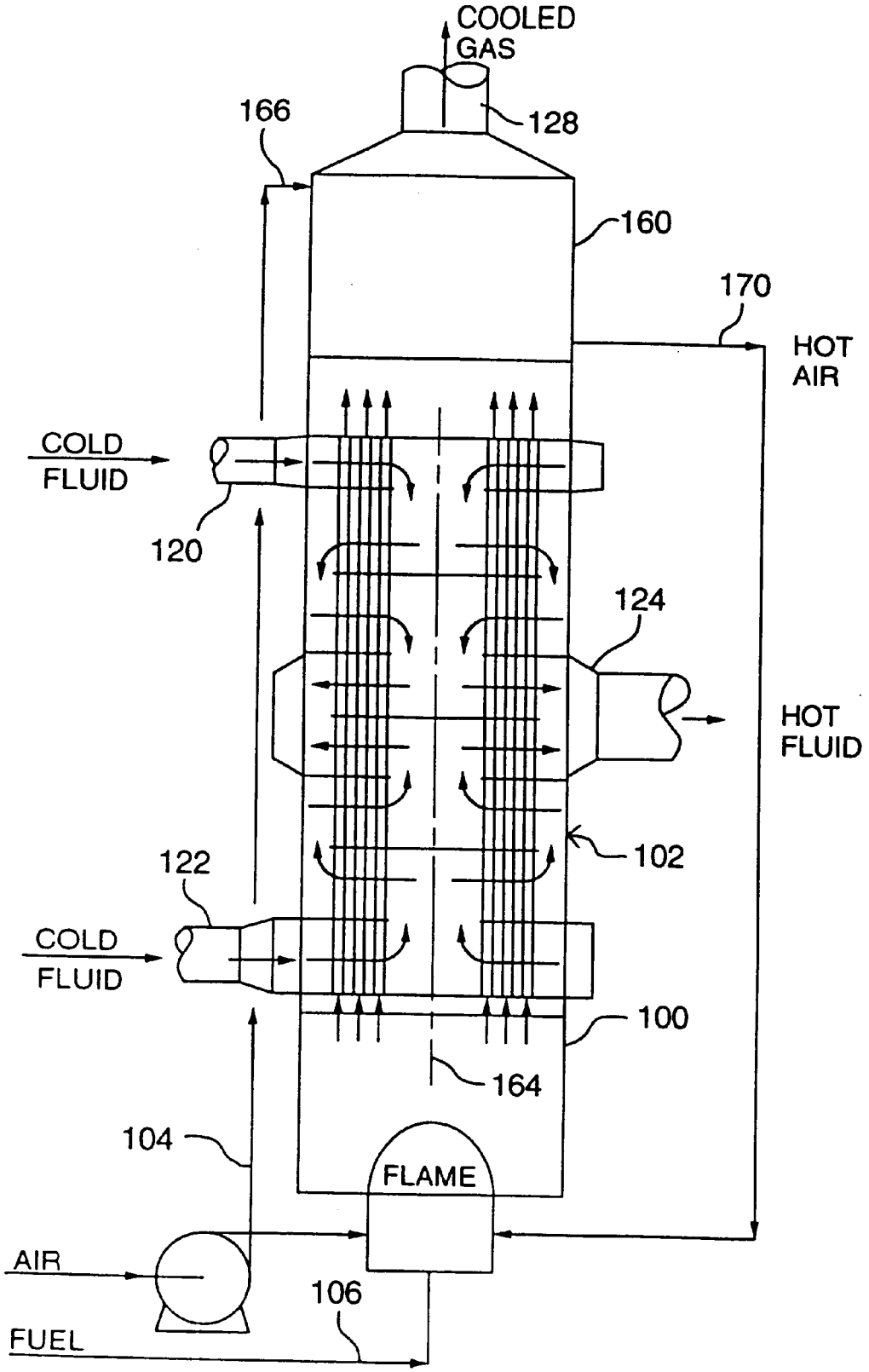
FIG. 5 represents a diagrammatic vertical cross-sectional view of a preheater system incorporating air preheating, according to the invention.

FIG. 5 shows an air heater 160 supported by exchanger 102 having a central axis co-axial with the vertical axis of the plurality of tubes and furnace 164. Heater 160 receives an air stream from conduit 166 to the shell side of air heater 160 and in counter-current flow to upward stack gas flow and then to furnace 100 via conduit 170.

Figure 6:
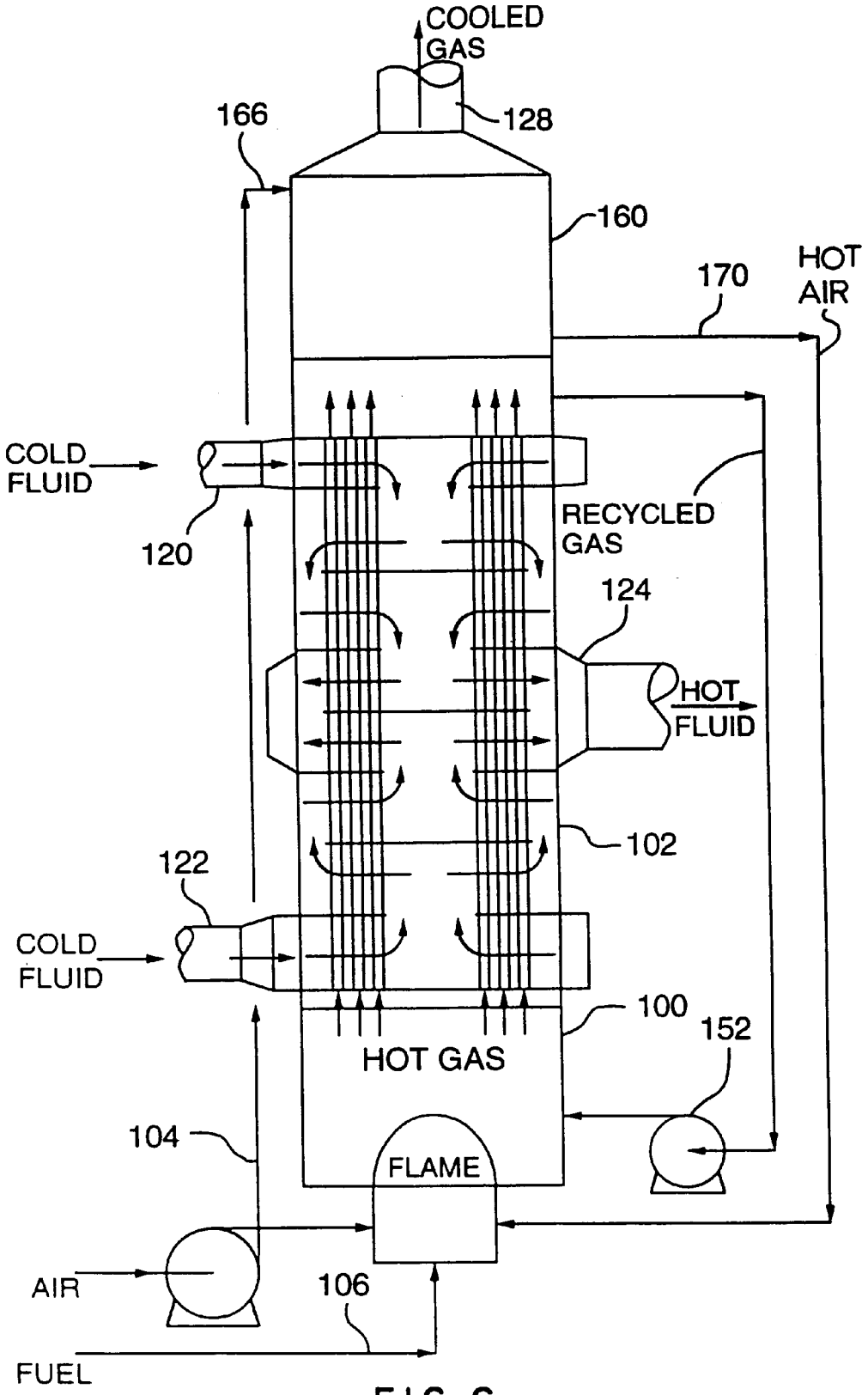
FIG. 6 represents a diagrammatic vertical cross-sectional view of a preheater system incorporating air preheating and stack gas recycle, according to the invention.

FIG. 6 incorporates both stack gas recycle and air preheating in the preheater system. Here the three process units are arranged axially in a vertical line and the flow of air 104 through the air heater 160 preheats the air before it enters the furnace 100 where it is used for primary combustion. The recycled stack gas is shown as taken from the exit of the exchanger 102 and is recirculated through fan or blower 152 to the furnace 100. The quantity of recycled stack gas depends on the level of excess oxygen that must be present in the stack gas to ensure that combustion is complete and that nitrogen oxide formation is minimized. This arrangement offers very high efficiencies as the quantity of stack gas is set primarily by the amount of fuel burned and the air heating has dropped the stack gas temperature to minimum values.

The subject of preheater system efficiencies is now considered using, as a base, combustion of natural gas which is a preferred fuel. In simple terms the air in the furnace is heated up to a given temperature and cooled down in the process heater. For the simplest case shown in FIG. 1 the air is heated by combustion to 450 degrees C. from 25 degrees and the combustion gas is cooled down from 600 degrees C. to 320 degrees, recovering 280 degrees of heat from the furnace gas out of 575 degrees, corresponding to a thermal efficiency slightly below 50%.

For the next case shown in FIG. 3 the furnace temperature has been raised to 1000 degrees C. and the gas is cooled in the preheater to 375 degrees C. The heat input to the furnace gas is 1000 less 25 or 975 degrees. The gas is cooled in the exchanger from 1000 to 375 degrees or 625 degrees so the efficiency is then 625 out of 975 degrees or around 64%.

Where stack gas is recycled around the system, as is the case in FIGS. 2 and 4, the efficiency is raised by the heat recovered by recycle. Assuming for example that the recycle stream has approximately the same heat capacity as the incoming air, the mixed air plus gas fed to the furnace will be at a mix temperature of 375 plus 25 or 200 degrees and the heat input to the furnace gas is 1000 less 200 or 800 degrees while the heat transferred is 1000 less 375 or 625 degrees. The efficiency is now 625/800 or 78%.

In the next case, FIG. 5, the air entering the furnace has been preheated by the stack gas and the overall effect is to decrease the stack gas temperature. Assuming for example a reduction of stack gas temperature of 125 degrees, the effect is to increase the efficiency from the Case 3 value of 625/975 to 625/850 or from 64% to 74%.

Combining the two improvement features as in FIG. 6 with the same assumptions will further increase the efficiency by raising the inlet gas mixture temperature to the furnace to 285 degrees while decreasing the temperature of stack gas to 260 degrees giving an efficiency of 720/785 or 92%.

These numbers while only approximate illustrate the effects of the changes on efficiency.

Consider next the advantage of the split flow on top of the other features. Consider the same metal temperature of 650 degrees C. as a design point. For the conventional design this point is at the hot tube sheet. With 485 degree C. process gas and 1000 degree C. furnace gas there is a 515 degree (C.) difference between the two streams and the metal will be slightly closer to the colder shell side stream and probably above the 650 (C.) limit. With split flow, the hot tube sheet will be between 90 degrees (C.) (the cold shell side stream) and the 1000 (C.) furnace gas and much colder than in the previous case. Even at 1200 degrees (C.), the tube sheet will still be significantly colder than the previous case and the 650 (C.) figure previously cited. The hottest point in the exchanger will be at the point where the two streams have been heated to 485 (C.) and the tube side gas is half cooled from 1200 to 375 degrees, i.e. at 790 degrees (C.). Here the difference between the two fluids will be 300 (C.) and the tubes are likely to be at 485 plus 90 or 590 (C.) degrees, below the 650 (C.) limit previously suggested. Clearly the furnace temperature could be increased even higher without violating this constraint.

It is also obvious that increasing furnace temperature with a fixed stack temperature results in increasing efficiency and in reducing the stack gas that has to be recycled.

There are many variations on this concept which will be apparent to the practitioner skilled in the heat transfer art including points of fluid take-off and fluid injection and methods for combining the process vessels. Such include use of an intermediate tube sheet in FIGS. 5 and 6 between the air heating and process heating portions of the heat exchanger train, the recycle of stack gas from between the two exchangers, combination of the recycled stack gas with the air in the air heater and the use of a single fan for simplicity, and use of uneven splits between the streams of process gas to the process heat exchanger. The take-off point of the heated gas can also be shifted along the axis of this exchanger for a variety of reasons and it would also be possible as part of the consideration to set up the process exchanger with two sections, a top countercurrent zone to improve thermal efficiency and a second parallel flow lower zone to lower metal temperatures in the region where the hot furnace gas is in the tubes. This two zone approach would however require a much larger shell as the shell flow would be equal to the total process gas flow as opposed to approximately half as in the preferred embodiment.

It is also possible by varying the baffle spacing to improve the shell side heat transfer coefficient in the region where the tubes are hottest and thus lower even further the metal temperature at the hottest points in the exchanger.

Figure 7:
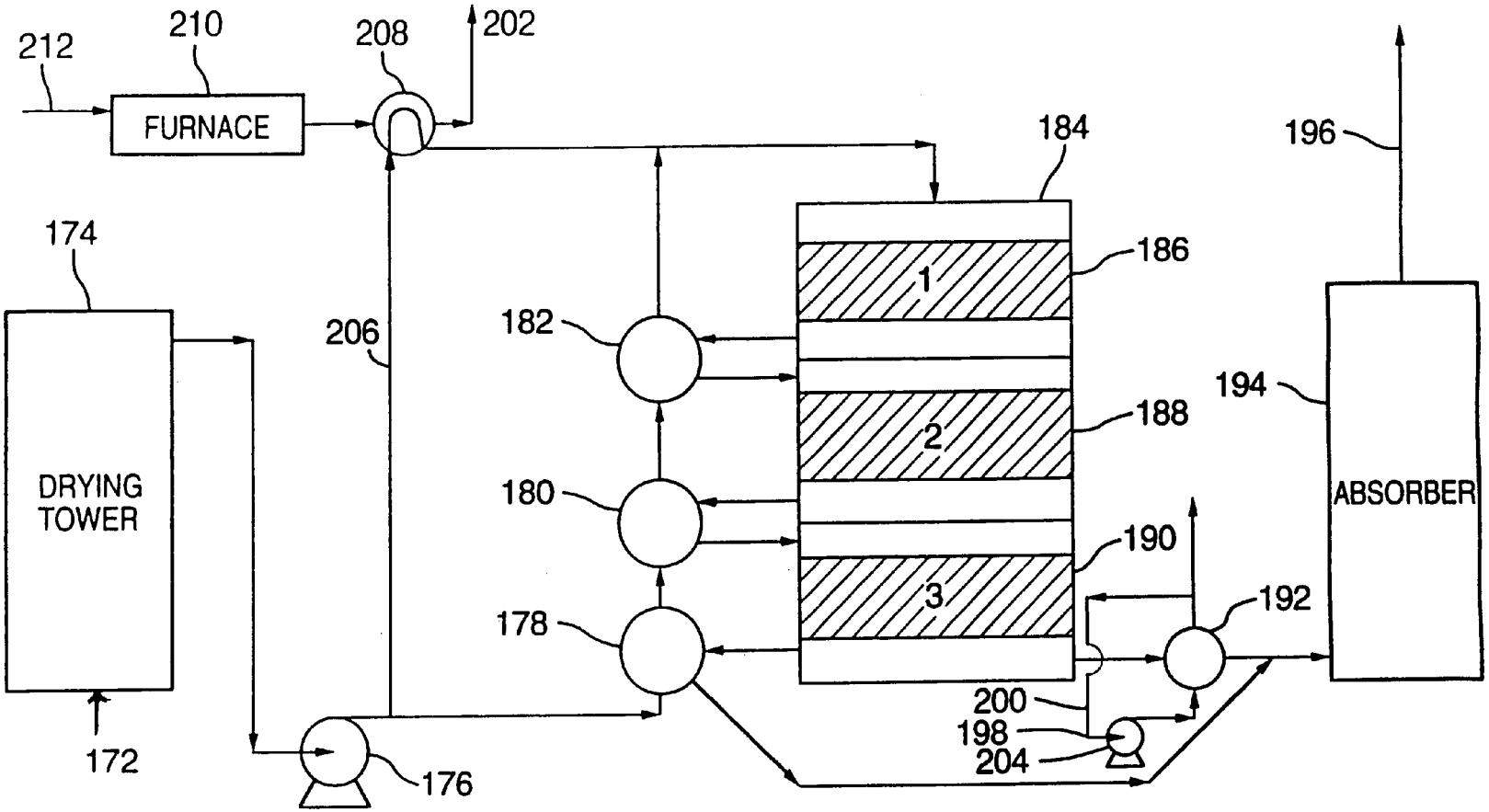
FIG. 7 represents a diagrammatic flow diagram of a single absorption sulphuric acid plant comprising heat exchangers according to the invention.

With reference to FIG. 7, this shows a flow diagram for a single absorption plant associated with a $SO_2$-containing gas stream and comprising different heat transfer operations according to the invention.

A wet $SO_2$-containing gas stream 172 passes through a drying tower 174 to a blower 176 and then through three heat exchangers in series, namely, Cold Exchanger 178, Intermediate Exchanger 180, and Hot Exchanger 182, before entering converter 184 where the gas passes through first catalyst bed 186 from which the gas passes through exchanger 182, reenters converter 184 and passes through a second catalyst bed 188. Converted gas from bed 188 then passes through intermediate exchanger 180 to a third catalyst bed 190 and is then split between cold exchanger 178 and $SO_3$ Cooler 192. Cooled $SO_3$-containing gas then flows to absorber 194 and to plant stack 196. Cooling in the cooler 192 is provided by an air stream 198 and hot, recycled air stream 200 circulated by a fan 204.

For an initial heating of the plant, a stream 206 of cold compressed gas from blower 176 passes through a heater 208 to converter 184. In heater 208, the $SO_2$-containing gas is heated by a hot furnace gas stream produced in furnace 210 by combustion of fuel in air stream 212. Cooled combustion products exit to atmosphere after the exchanger 208 through a plant stack 202. This flowsheet shows the location of four heat exchangers and process steps according to the invention, i.e., exchangers 180, 182, 192 and 208.

Figure 8:
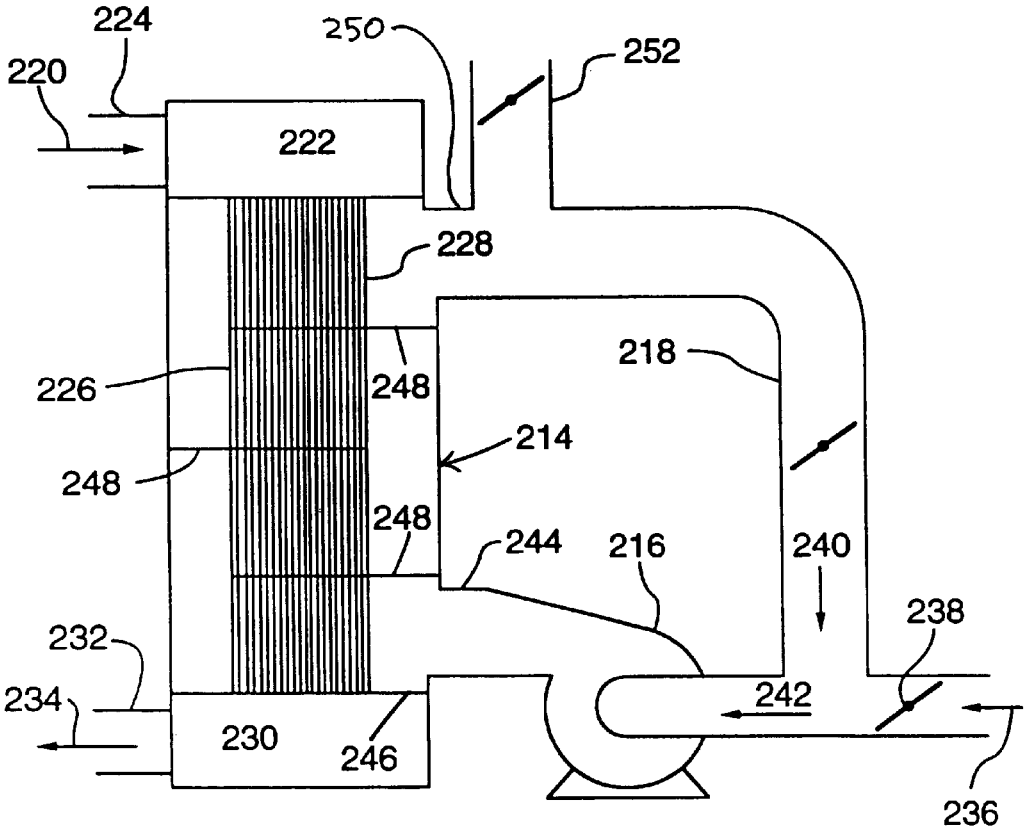
FIG.8.(PRIOR ART)
FIG. 8 is a schematic vertical sectional view of an $SO_3$ cooling system incorporating a heat exchanger according to the prior art.

FIG. 8 shows generally as 214 a prior art $SO_3$ cooler, associated fan 216 and recirculating conduit 218. Incoming hot $SO_3$-containing gas 220 enters a top vestibule 222 through a nozzle 224 in exchanger 214 and then flows downwardly through tubes 226 of the exchanger tube bundle 228 to a bottom vestibule 230 and leaves exchanger 214 through nozzle 232 as stream 234. Cooling air stream 236 enters the heat exchanger system through flow control damper 238 and mixes with a hot recirculated air stream 240. The combined stream 242 then passes through fan 216 and enters exchanger 214 through nozzle 244 to the shell side of exchanger 214 immediately above the lower tube sheet 246. Within exchanger 214, air flow is directed by baffles 248 across tube bundle 228 and leaves the shell space through nozzle 250 from which it flows either to atmosphere through the stack 252 or through recycle line 218 back to fan 216. Variations of this design involve passing the cooling air through the tubes and using a variety of baffle configurations.

Figure 9:
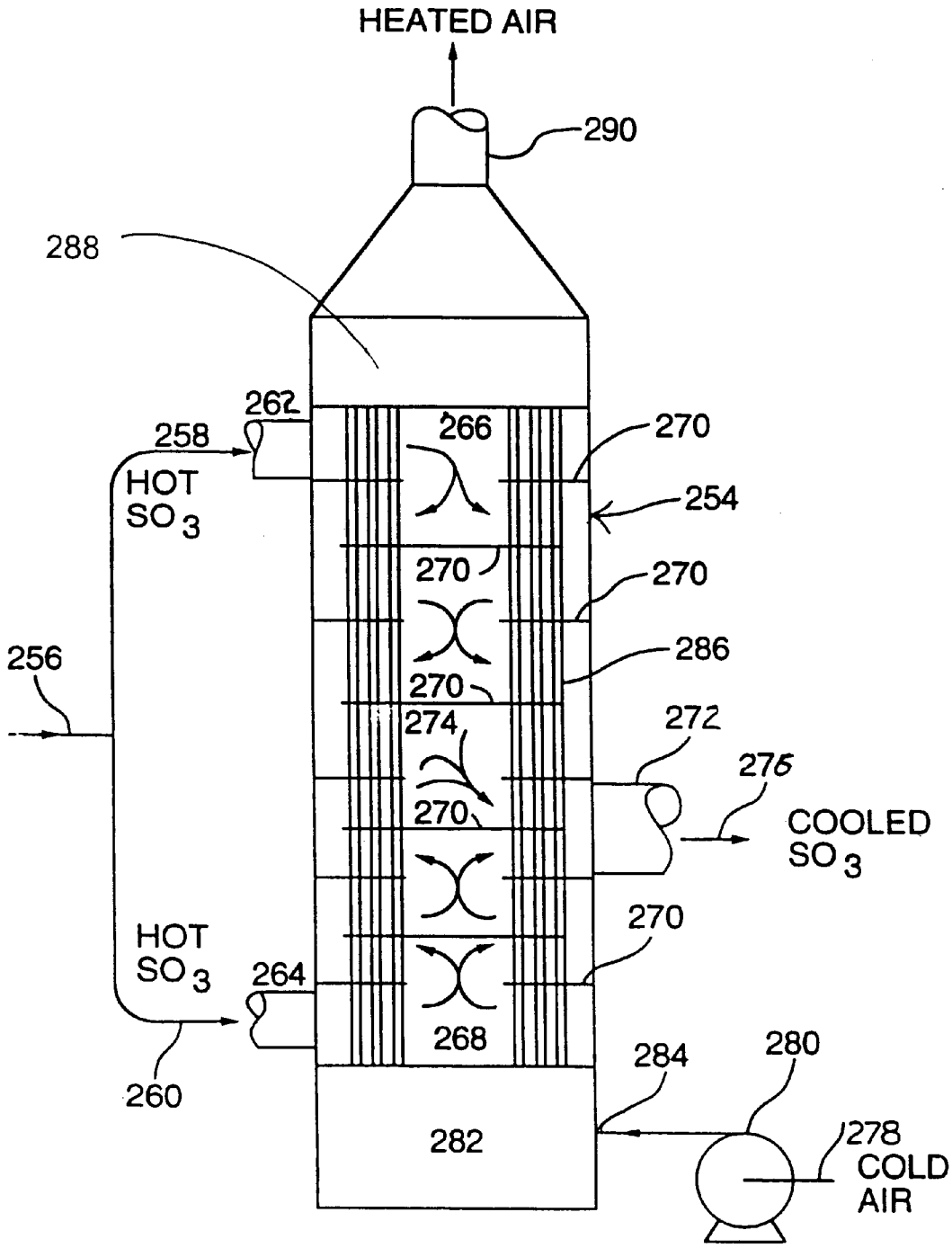
FIG. 9 is a schematic vertical sectional view of a $SO_3$-cooler/air heater according to the invention.

FIG. 9 shows an $SO_3$-cooler/air heater apparatus generally as 254 according to the invention, wherein exchanger 254 has two shell side inlets operatively providing from a combined gas source (not shown) through common conduit 256 essentially equal amounts of $SO_3$-containing hot gas streams 258, 260 entering through aperture nozzles 262 and 264, respectively, to respective first and third shell spaces 266 and 268, respectively, with the shell side gases being directed by baffles 270 to a common exit aperture nozzle 272 adjacent second shell space 274 through which the combined cooled $SO_3$ gas stream 276 leaves exchanger 254. Incoming cooling air 278 is compressed by fan 280 and passes into the lower vestibule 282 through nozzle 284 and then flows up through the tubes 286 to the upper vestibule 288 and out of stack 290.

Figure 10:
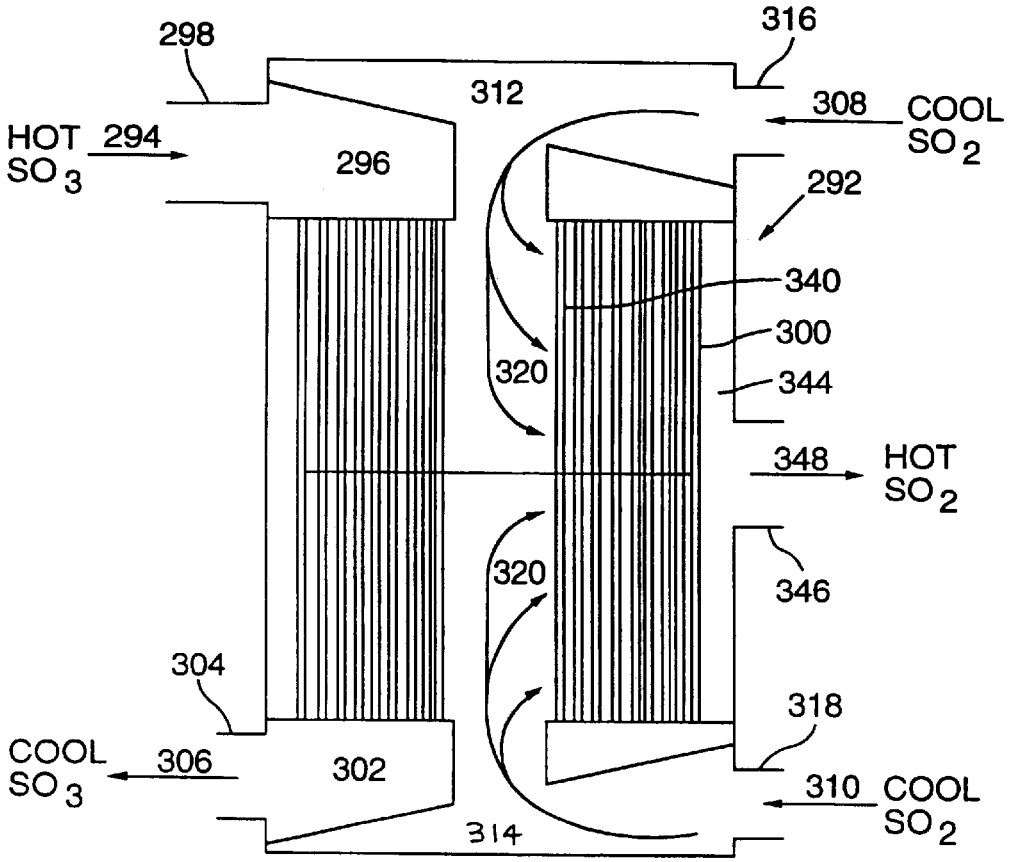
FIG. 10 is a schematic vertical sectional view of an alternative heat exchanger according to the invention.

FIG. 10 shows generally as 292 a further embodiment of the invention suited for use as an inter-bed heat exchanger. Exchanger 292 has an inlet hot $SO_3$ gas stream 294 entering an upper tube side space 296 through nozzle 298 and flowing down through the tubes 300 to a lower tube side vestibule 302 and leaving the exchanger through nozzle 304 as cool $SO_3$-stream 306. Incoming cold $SO_2$-containing gas is split essentially equally into streams 308 and 310 and enters shell and vestibules 312, 314 through nozzles 316, 318, respectively, and flows to the core 320 of the annular tube bundle 340. The gas flows radially outwardly through bundle 340 to the tube-free outer annulus 344 and through single nozzle 346 as stream 348 to the next process step.

While FIG. 10 shows only a single pass of gas across tube bundle 340 and with hot gas flowing in the tubes, it will be obvious to those skilled in the art that the fluids can be reversed and that several crossflow passes across the tube bundle can be used.

Figure 11:
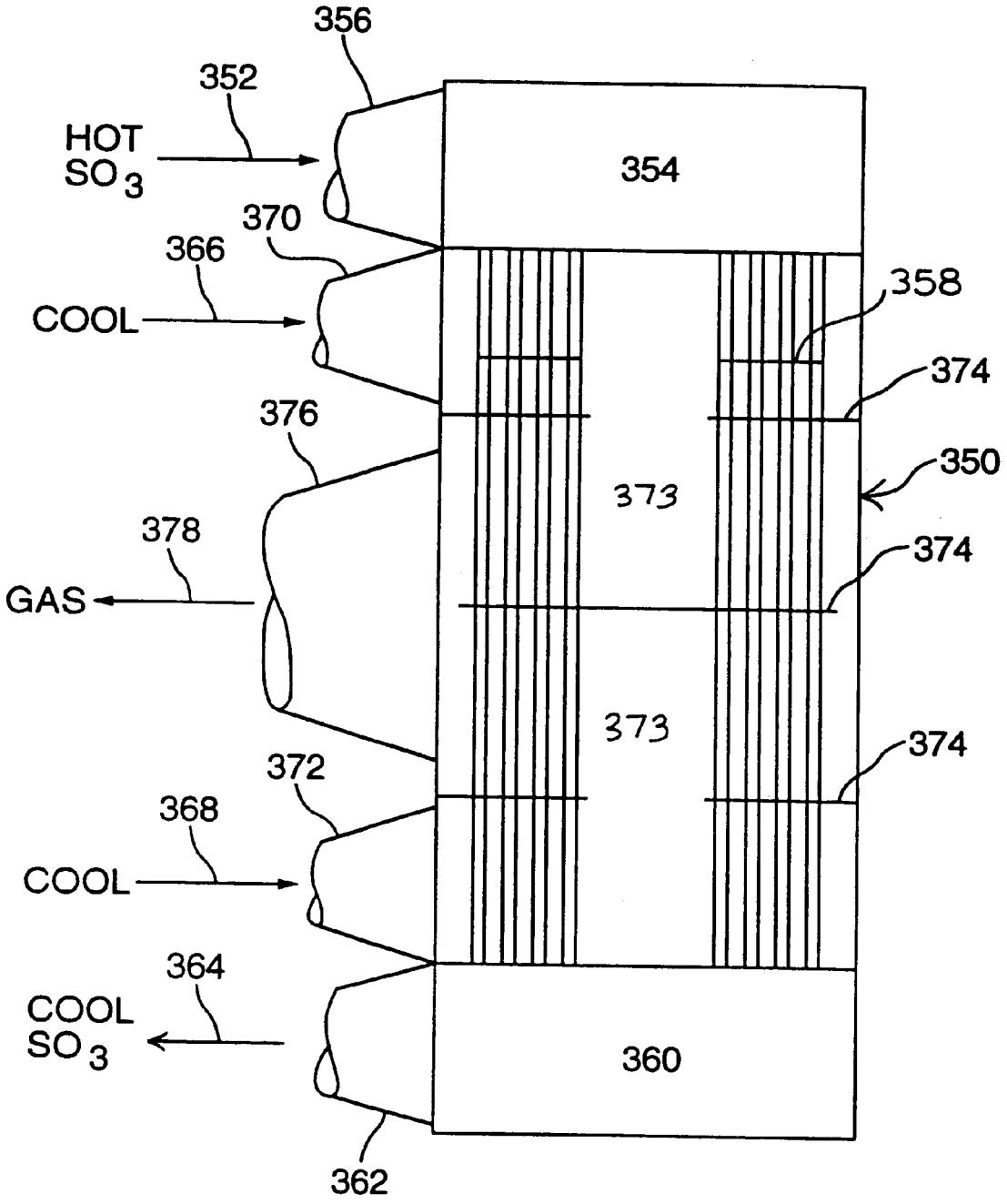
FIG. 11 is a schematic vertical sectional view of a yet further alternative heat exchanger according to the invention; and wherein the same numerals denote like parts throughout the figures and arrows denote gas or other fluid flows.

With reference to FIG. 11, this shows exchanger generally as 350 having an inlet hot $SO_3$-gas stream 352 entering an upper vestibule 354 through $SO_3$ gas inlet nozzle 356, flowing down through tubes 358 to the lower vestibule 360 and leaving the exchanger through nozzle 362 as cool $SO_3$-stream 364. Cooling gas enters as two essentially equal streams 366, 368 through shell nozzles 370, 372, respectively, to flow in the shell space 373 as directed by baffles 374 to exit as gas stream 378 through outlet nozzle 376 with the cooling gas leaving as a single stream. In this embodiment, the flow in the upper portion of the shell is co-current while the flow in the lower section is counter-current and there are two flow passes in each zone of the exchanger.

Many variations of this arrangement will be apparent to the skilled person as the gas streams can be reversed. Baffle arrangements can range from single to double segmental baffles or disc-and-donut baffles, and the shell side flow can enter as a single stream and leave as split streams.

The practice of the invention is further illustrated by reference to the following examples.

Example 1 contrasts two $SO_3$ cooling system designs, one using conventional technology with air recycle and a second design using instant invention. In both cases, the gas stream from the last pass of a 1000 STPD metallurgical sulphuric acid plant treating a gas containing 10% $SO_2$ and 12% oxygen with an overall conversion efficiency of 98% has been used. The gas is cooled from 800° F. to 400° F. while heating ambient air from −40° F. to 500° F. In the conventional case, hot air is recycled to bring the inlet air temperature to 250° F. to avoid condensation in the $SO_3$ gas being cooled while in this embodiment according to the invention no recycle is needed.

For comparison purposes equal pressure losses and the same performance parameters and minimum metal temperatures have been used. The results are shown in the following table:

| PHYSICAL CHARACTERISTICS OF APPARATUS | APPARATUS CONVENTIONAL | APPARATUS ACCORDING TO THE INVENTION |
|---|---|---|
| Diameter (ft) | 13 | 8.5 |
| Area (sq ft) | 21300 | 15563 |
| Length (ft) | 42 | 32 |
| Tubes | 1490 | 1232 |
| Tube Diam (in) | 1.75 | 1.50 |
| Weight (tons) | 80 | 44 |
| Blower HP | 180 | 100 |
| H.E. Air Flow (cfm) | 175000 | 87000 |

This evaluation demonstrates that adequate metal temperatures can be achieved without gas recycling using the present invention even with very cold air. In practice, the exchanger design using the present invention will be slightly larger than shown in the above table as it must work with summer air temperatures. However, it will still be well below the size of the unit using the counter-current exchanger which needs air recycle. While the teachings generally assume equal division of the shell side fluid into two equal streams, where there is a temperature constraint, there may be a good case for keeping the thermal capacity of the shell stream in the co-current section at least equal to that of the tube side fluid. This modification will ensure that the co-current heat transfer will maintain constant metal temperatures as the two fluids approach each other in temperature. The counter-current shell side gas flow will then accept the remaining shell side gas flow.

Examples 2 and 3 show the effect of the practise of the invention on exchanger designs prepared for a plant producing 1800 STPD of sulphuric acid from metallurgical gas using double absorption. The Hot Exchanger after bed 1 and the Hot IP Exchanger after bed 2 were evaluated for conventional apparatus and for apparatus according to the invention. In Example 2, the Hot Exchanger heats $SO_2$-containing gas from the Cold Exchanger to the inlet temperature needed in Bed 1 while cooling $SO_3$ containing gas between beds 1 and 2. In Example 3, the Hot IP Exchanger similarly cools $SO_3$-containing gas between beds 2 and 3. The $SO_2$ gas in the Hot Exchanger comes from a previous exchanger (not shown) and then goes to bed 1 while the $SO_2$ gas in the Hot IP Exchanger comes from another exchanger (not shown) and goes to bed 4. In both cases, the hot $SO_2$ gas leaving the exchanger is slightly cooler than the outlet $SO_3$ gas temperature.

Consideration is now given to the Hot Exchanger. Four designs cases are shown for comparison purposes.

Case 1 relates to a conventional radial exchanger with two shell passes and one tube pass.

Case 2 relates to a design using radial cross-flow and a single shell pass from core to annulus, an improvement over the previous case. Case 2 builds on prior art and the disc-and-donut design concept design concepts.

Case 3 which uses the present invention has a single shell pass design and connections to both ends of the core.

Case 4 shows a split flow unit with two connections to the ends of the shell annular space and a single central shell exit connection and also uses the present invention, combining a two pass shell design with split shell side gas flow. The results of the evaluation are as follows:

| Case No. | Shell Passes | Pressure Exchanger Diam | Pressure Exchanger Drop | Pressure Exchanger Area (sg?) |
|---|---|---|---|---|
| 1 | 2 | 168" | 22" | 20,800 |
| 2 | 1 | 164" | 10" | 21,600 |
| 3 | 1 | 134" | 12" | 22,600 |
| 4 | 2 | 140 | 12" | 19,800 |

Thus, Cases 1 and 2 represent prior art while 3 and 4 utilize the present invention. The effect on exchanger physical size and flow resistance is clearly shown. The actual areas depend very much on the detailed design and are considered to be essentially the same. Case 1 uses a hexagonal tube pitch with two shell passes and two full capacity shell nozzles. The shell size of 168" is at the limits at which the exchanger can be shipped. The pressure drop of 22" indicated is common with prior art exchangers and significantly greater than the values shown for cases 2, 3, and 4.

For Case 2 single pass shell side flow was used with radial outward flow in the shell. As can be seen in the table, this design has a much lower flow resistance and is therefore more desirable than the standard design of Case 1.

The tube temperatures in this design will vary as was the case in FIG. 9 but the difference in temperature across the bundle is symmetrical and possible to allow for in mechanical design.

Case 3 is the first example incorporating the instant invention. Here, the design includes two connections to the core so that the flow in the core at any point is only half of the total flow. The shell flow has been left as single pass. With a half flow in the core, a smaller core can be used and the whole annular bundle is shifted toward the axis of the exchanger and the shell decreases in size from 168" to 134". This smaller dimension makes the unit very easy to fabricate and ship and the low pressure drop which it has in common with Case 2 offers operating savings to the owner. Case 4 incorporates a different embodiment of the invention with split flow in the shell. Again, the core only handles half flow and is correspondingly smaller, shrinking the overall exchanger dimensions. The pressure loss, diameter, and area are all attractive by comparison with the Case 1 conventional approach.

Example 3 concerns the Hot IP Exchanger. This exchanger normally has about half the heat load of the Hot Exchanger. However, it handles essentially the same flows of processes gas in an acid plant and the size is almost the same. Case 1 uses prior art design and has two full-size shell nozzles and full flow in the core space as in the Hot Exchanger Case 1. Case 2 uses prior art techniques with a single shell pass and flow from the core to the annulus as in the Hot Exchanger Case 2. Case 3 uses the invention and has two co-connections with a single shell pass. Case 4 uses the invention as well and has split shell flow with two shell inlet nozzles and a central shell outlet nozzle. One zone is in co-current flow with the tube side gas while the other zone has counter-current flow.

| Case | Shell | Shell Pressure Exchanger | | |
|---|---|---|---|---|
| No. | Passes | Diam | Loss | Area |
| 1 | 2 | 168" | 7" | 19,400 |
| 2 | 1 | 163" | 8" | 18,600 |
| 3 | 1 | 139" | 9" | 17,700 |
| 4 | 2 | 134 | 20" | 21,500 |

From this table, it is clear that steps which reduce the gas flow at any point in the core of an annular exchanger where there is little overlap in process gas temperature will result in significantly smaller equipment and lower flow resistance. The conclusion is valid both when two shell paths are generated by duplicating shell nozzles and when two nozzles are connected to the core space. It can be seen from the above three worked examples that there will be significant economies of capital and materials of construction resulting from use of the invention in design of future exchangers.

The invention also can be used in single pass shell flows where there is no overlap in temperatures such as in the Hot and Hot IP Exchangers to multi-pass shell cross-flows in the case of $SO_3$ Coolers, Tail Gas or Air Heaters, or Preheat Exchangers. In the hereinbefore examples, symmetrical bundles with annular tube bundles and empty core and annular spaces have been used. Such designs are inherently symmetrical and, even with single pass shells, the differential expansion problems can be resolved. In many conventional cases, either single or double segmental baffles have been used in which the gas flows from side to side in a cylindrical shell and the tube temperatures are more variable than in the case shown. Where two shell nozzles are used as in the $SO_3$ Cooler application or in cases 4 of the succeeding two tables, an improvement can also be obtained in exchanger size and represents a significant improvement in the art which surprisingly has not been used industrially.

For smaller units the single segmental baffle design may also be preferred as given greater baffle spacing. The examples also show that the number of shell cross-flow passes may vary from one to any number set by the flow.

As already stated, it is not an essential feature that there need be the same number of shell passes in each zone. For a preheater it appears more advantageous to use fewer passes in the hot end of the exchanger and more passes in the counter-current zone where the temperature difference between fluids is less.

The tables also indicate that the invention can lead to significantly lower flow resistance designs with potential savings in operating cost to the eventual plant operator. The use of symmetry and the radial design concepts introduce possible designs which can operate successfully in single pass as well as multi-pass shell flow arrangements, which is a distinct improvement on conventional practice.

Variations on how nozzle connections are made and how passes are arranged will be apparent to those experienced in the art. Also, the flow need not be equally split between the two shell gas streams. It may be advantageous to vary the split for metal temperature control or to vary the location of the intermediate nozzle where the cooled gas leaves the exchanger. Yet further, it will also be apparent to those in the art that the concept of splitting the shell side flow is potentially applicable to other baffle arrangements.

A further key feature of the present invention is that it allows good metal temperature control in such exchangers where the acid plant is providing the motive force for the tube side gas movement as in Tail Gas Heaters or Air Heaters. The present design is also applicable in other industries where condensation risk exists but where there is also a significant incentive to recover heat from process gas, for example, to feed to a furnace.

A further aspect of the invention is the recognition that in large gas exchangers, the exchangers may contain large tube free regions for gas transfer and the tube bundle itself may only occupy a minor portion of the shell. Management of the shell size therefore requires management of the empty spaces within the shell. For conventional baffles, such an effort is of less value because of the flow patterns involved but with the radial design having axial and annular tube free zones, a reduction of the size of the core and annular space results in many advantages. One advantage is that the tube bundle then has a smaller inner circumference and gas flowing from the core will see more rows of tubes than with a larger core and will give better heat transfer. The bundle is therefore thicker which provides an advantage when there is limited surface area in the exchanger. A second advantage of use of a smaller core is that the overall exchanger diameter decreases. In many cases, the size may change from designs which must be fabricated in the field to readily shippable designs. This is a real and significant advantage to an owner. In FIGS. 9 and 11, two shell connections are shown which decrease the flow in any one zone of the exchanger core to half of the full stream. In FIG. 10 two core connections are used and the core is effectively split into two zones, each only seeing half of the shell flow as in FIGS. 9 and 11.

Although this disclosure has described and illustrated certain preferred embodiments of the invention, it is to be understood that the invention is not restricted to those particular embodiments. Rather, the invention includes all embodiments which are functional or mechanical equivalents of the specific embodiments and features that have been described and illustrated herein.

I claim:

1. In a shell and tube, gas-to-gas heat exchanger for use in the manufacture of sulphuric acid by the contact process involving heat transfer between dry gases, said exchanger comprising a shell having a first shell portion defining a first shell space, a second shell portion defining a second shell space and a third shell portion defining a third shell space, said second shell space being located between said first and said third shell spaces; an annular tube bundle comprising a plurality of tubes within said shell and extending longitudinally through said first shell space, said second shell space and said third shell space and defining a core space free of said tubes within said bundle and an annular space free of tubes between said shell and said annular bundle; said shell having a first gas conduit means and a second gas conduit means; each of said tubes having a tube gas input means and a tube gas output means and baffle means;

the improvement wherein said first shell portion further defines a first shell aperture in communication with said first shell space and through which a first gas stream operably passes; said second shell portion further defines a second shell aperture in communication with said second shell space and through which a second gas stream operably passes; said second shell portion being located centrally of said shell; said third shell portion further defines a third shell aperture in communication with said third shell space and through which a third gas stream operably passes; said baffle means so located within said first, said second and said third shell spaces as to operatively direct said first gas, said second gas and said third gas streams, within said first shell space, said second shell space and said third shell space, respectively, in radial flow across said tube bundle; wherein said second shell space constitutes a chamber within which said second gas stream comprises a mixture of said first gas stream and said third gas stream.

2. A heat exchanger as defined in claim 1 wherein said first shell aperture is an inlet to said first shell space for said first gas stream; said third shell aperture is an inlet to said third shell space for said third gas stream; said second shell space is a mixing chamber for said first gas and said third gas streams to produce said second gas stream; and said second shell aperture is an outlet for said second gas stream.

3. A heat exchanger as defined in claim 1 wherein said first shell aperture is an outlet from said first shell space for said first gas stream; said third shell aperture is an outlet from said third shell space for said third gas stream; said second shell space is a splitting chamber wherein said second gas stream is split to produce said first gas stream and said third gas stream and said second shell aperture is an inlet for said second gas stream.

4. A heat exchanger as claimed in claim 1 further comprising gas conduit means in communication with said first shell aperture and said third shell aperture whereby said first gas stream and said third gas stream emanate from or provide a common combined gas stream.

5. In a process gas preheater system for raising the temperature of a process gas by heat transfer with a hot furnace gas, said system having a combustion furnace in communication with a shell and tube heat exchanger, wherein said furnace operably produces said hot furnace gas and comprises air inlet means, fossil fuel inlet means, a combustion chamber, and hot furnace gas exit means; and said heat exchanger comprises an exchanger shell, a first end tube sheet and a second end tube sheet, which said shell and said tube sheets define a shell space;

a tube bundle comprising a plurality of longitudinal tubes retained by said first and second end tube sheets within said shell space and comprise heat exchange means;

hot furnace gas inlet means;

cooled furnace gas outlet means;

process gas inlet means; and heated process gas outlet means;

said plurality of tubes in communication with said hot furnace gas inlet means to operably provide said tubes with said hot furnace gas and said cooled furnace gas outlet means;

the improvement comprising said process gas inlet means having i. a first process gas inlet aperture adjacent said first tube sheet and in communication with said shell space, ii. a second process gas inlet apertures adjacent said second tube sheet and in communication with said shell space; and iii. a heated process gas outlet aperture located centrally of said shell in communication with said shell space.

6. A preheater system as claimed in claim 5 wherein said heated process gas outlet means comprises a gas outlet aperture essentially midway between said first and said second tube sheets and in communication with said shell space.

7. A preheater system as claimed in claim 5 wherein said tubes of said heat exchanger are aligned substantially vertically above said furnace.

8. A system as claimed in claim 5 wherein said process gas is selected from the group consisting of air and sulfur dioxide.

9. A system as claimed in claim 5 further comprising a distinct secondary heat exchanger having a plurality of vertically aligned secondary tubes co-axially disposed above said heat exchanger.

10. A system as claimed in claim 5 wherein said furnace is vertically aligned and has means to operably direct input air flow and input fuel flow vertically upward to operatively create a vertical flame substantially central around the vertical axis of the furnace and wherein the tube bundle of the heat exchanger is vertically aligned and disposed above the furnace such that the central axis of the bundle is co-axial with the aforesaid furnace vertical axis.

* * * * *